US007581983B1

(12) United States Patent
Yuan et al.

(10) Patent No.: US 7,581,983 B1
(45) Date of Patent: Sep. 1, 2009

(54) CONNECTOR FOR FLEXIBLE PRINTED CIRCUIT BOARD

(75) Inventors: Sheng Tsung Yuan, Tu-Cheng (TW); Yung Chi Peng, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/314,286

(22) Filed: Dec. 8, 2008

(51) Int. Cl.
*H01R 12/24* (2006.01)

(52) U.S. Cl. ..... 439/495

(58) Field of Classification Search ..... 439/495, 439/498, 260
See application file for complete search history.

(56) References Cited

U.S. PATENT DOCUMENTS 6,146,172 A * 11/2000 Wu et al. ..... 439/260
6,508,661 B1 * 1/2003 Yu ..... 439/495
7,527,511 B1 * 5/2009 Peng et al. ..... 439/260

* cited by examiner

*Primary Examiner*—Phuong K Dinh
(74) *Attorney, Agent, or Firm*—Rosenberg, Klein & Lee

(57) ABSTRACT

A connector includes an insulating housing defining a first mouth and a receiving recess, a plurality of first terminals disposed in the insulating housing and stretching into the first mouth, a first actuator rotatably mounted to the first mouth, and a plurality of second terminals disposed in the insulating housing and each having two connecting arms spaced from each other. Free ends of the connecting arms respectively define a contact portion stretching into the receiving recess. Wherein one flexible printed circuit board can be inserted into the first mouth and pressed downward by the first actuator to electrically contact the first terminals, another flexible printed circuit board can be inserted into the receiving recess and clipped between the connecting arms to electrically contact the contact portions.

10 Claims, 5 Drawing Sheets

CONNECTOR FOR FLEXIBLE PRINTED CIRCUIT BOARD

BACKGROUND OF THE INVENTION

1. Field of the Invention

The present invention generally relates to a connector for a flexible printed circuit (FPC hereinafter for simplification) board, and more particularly to an FPC connector capable of receiving two FPC boards therein.

2. The Related Art

A traditional FPC connector includes an insulating housing defining a mouth, a plurality of terminals disposed in the insulating housing, and an actuator rotatably mounted to the mouth of the insulating housing so as to be opened or closed freely. After an FPC board is inserted into the mouth of the FPC connector, the actuator is rotated from an open position to a closed position so as to ensure an electrical connection between the FPC board and the terminals of the FPC connector. However, the traditional FPC connector can only receive one FPC board therein. With the development of electrical field, electrical products are gradually microminiaturized, thus an FPC connector capable of receiving two or more FPC boards therein is required.

SUMMARY OF THE INVENTION

An object of the present invention is to provide a connector which can receive at least two flexible printed circuit boards therein. The connector includes an insulating housing defining a first mouth at a front thereof and a receiving recess behind the first mouth, a plurality of first terminals disposed in a front of the insulating housing and stretching into the first mouth, a first actuator rotatably mounted to the first mouth of the insulating housing, and a plurality of second terminals disposed in a rear of the insulating housing. The first mouth has a top and a front opened freely. The receiving recess is higher than the first mouth and has a front opened freely. Each of the second terminals has a second connecting arm at an upper portion thereof and a third connecting arm at a lower portion thereof. A free end of the second connecting arm protrudes downward to form a second contact portion and a free end of the third connecting arm protrudes upward to form a third contact portion. The second and third contact portions stretch into the receiving recess. Wherein one of the flexible printed circuit boards can be inserted into the first mouth and pressed downward by the first actuator to electrically contact the first terminals, the other flexible printed circuit board can be inserted into the receiving recess and clipped between the second and third connecting arms to electrically contact the second and third contact portions of the second terminals.

As described above, the foregoing connector can simultaneously receive two flexible printed circuit boards therein from the same direction such that can suffice a microminiaturization requirement with the development of electrical field.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
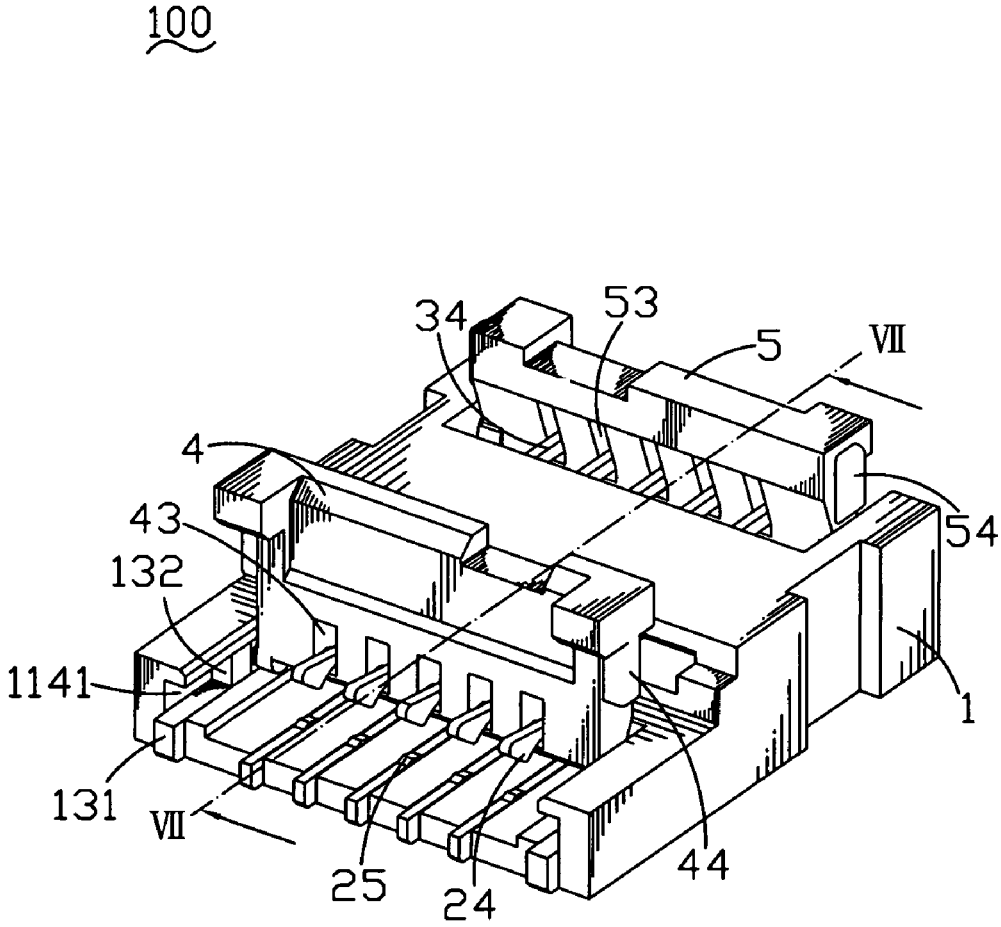
FIG. 1 is a perspective view of an FPC connector in accordance with the present invention.
Figure 2:
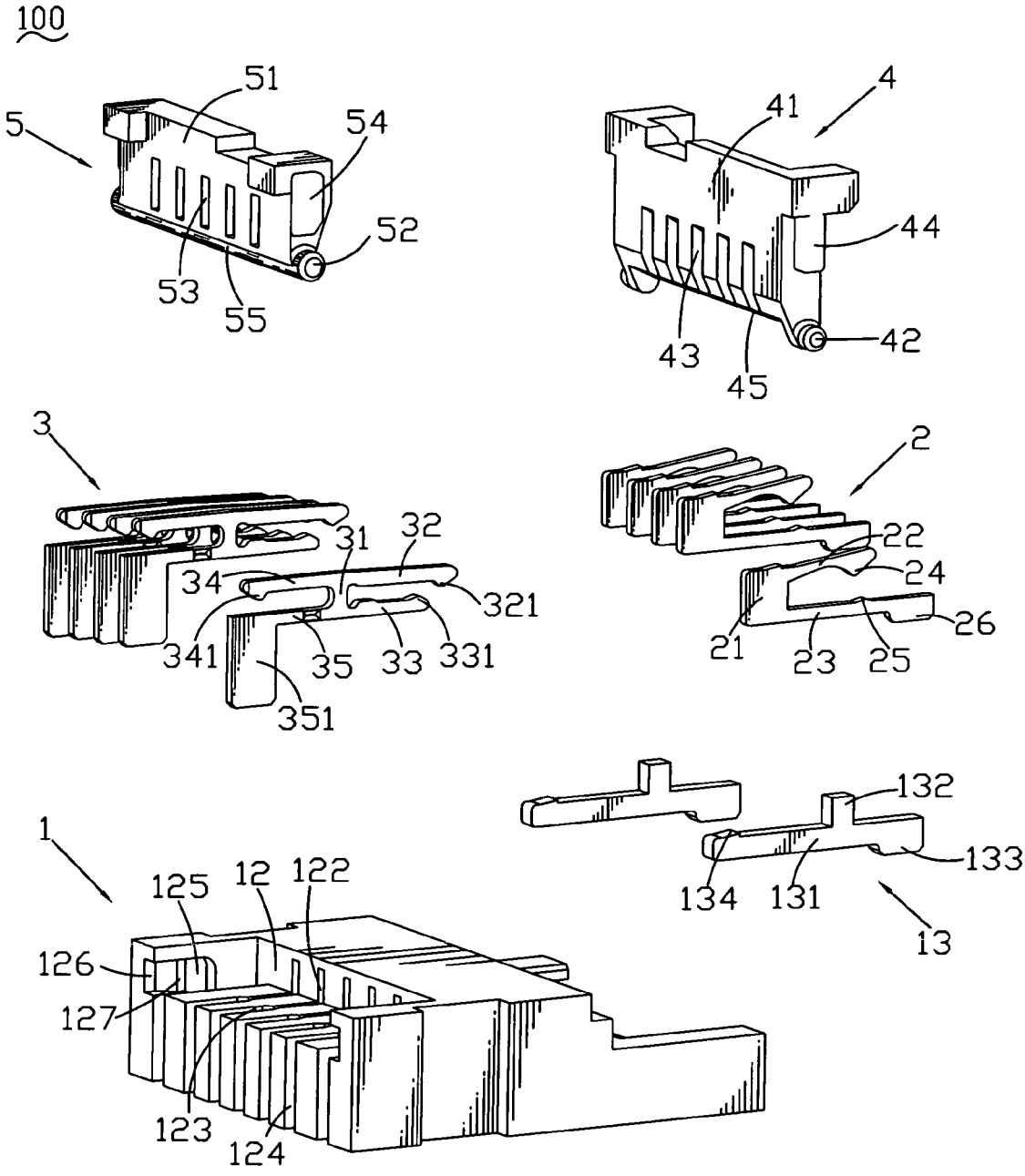
FIG. 2 is an exploded view of the FPC connector of FIG. 1.
Figure 6:
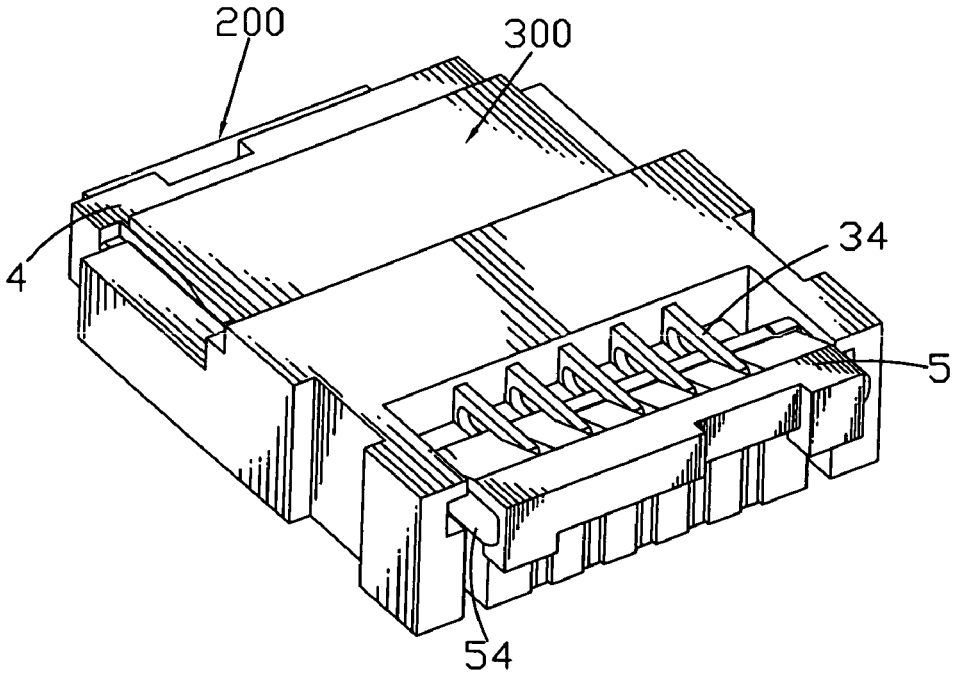
FIG. 6 is a perspective view showing that both the first FPC board and a second FPC board are inserted in the FPC connector.

With reference to FIG. 1, FIG. 2 and FIG. 6, an FPC connector 100 according to the present invention can receive a first FPC board 200 and a second FPC board 300 therein from a same direction and includes an insulating housing 1, a plurality of first terminals 2, a plurality of second terminals 3, a first actuator 4, a second actuator 5 and a pair of support members 13 disposed in the insulating housing 1 respectively.

Figure 3:
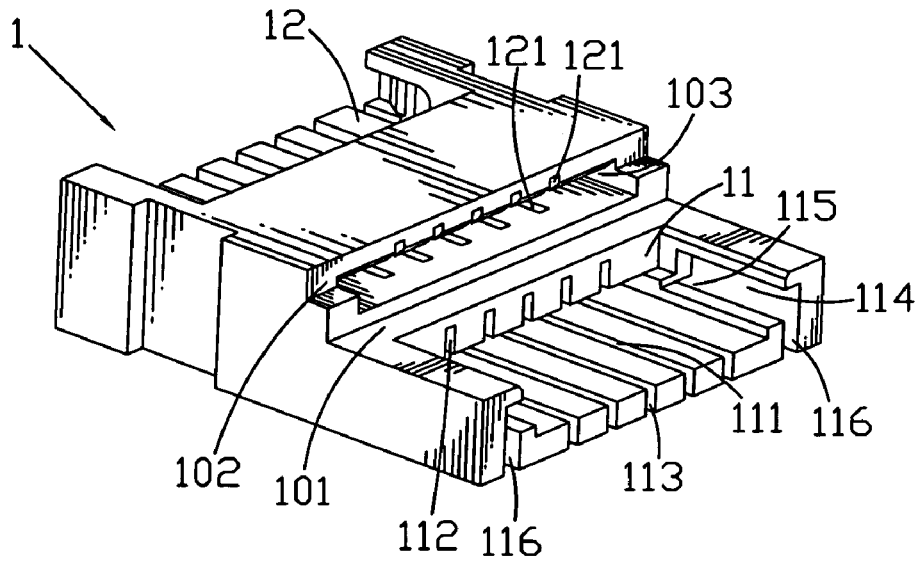
FIG. 3 is a perspective view of an insulating housing of the FPC connector of FIG. 1.
Figure 4:
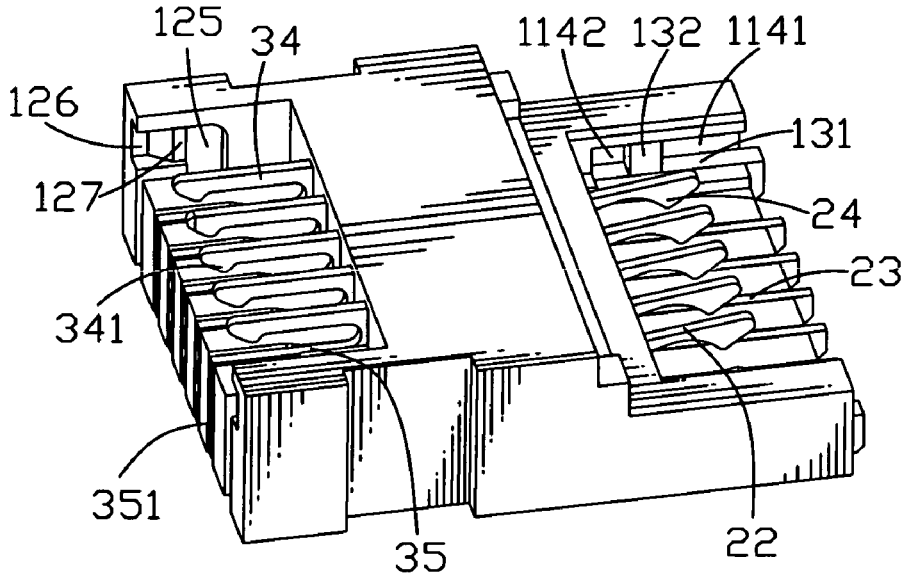
FIG. 4 is a perspective view of the FPC connector without a first actuator and a second actuator.
Figure 5:
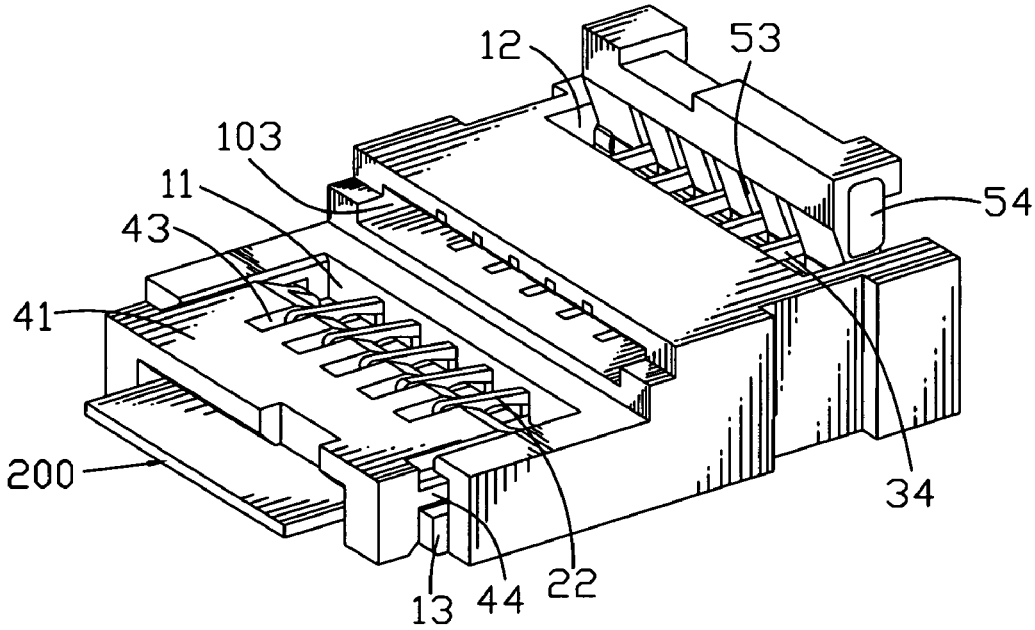
FIG. 5 is a perspective view showing that a first FPC board is inserted in the FPC connector.

Referring to FIGS. 2 and 3, the insulating housing 1 is substantially of rectangular shape. A top of the insulating housing 1 defines a rectangular first space 101 penetrating through a front and two opposite sides thereof, and a rectangular second space 102 connected with a rear top of the first space 101. A bottom middle of the first space 101 extends downward to form a rectangular first mouth 11 having a front opened freely. A bottom of the first mouth 11 defines a plurality of first passageways 111 arranged at regular intervals along a transverse direction thereof and each extending longitudinally. A rear end of each first passageway 111 vertically extends to a rear of the first mouth 11 to form a first receiving cavity 112, and a front end of each first passageway 111 extends downward to penetrate through the insulating housing 1 to form a first fixing cavity 113. Two opposite sides of the first mouth 11 extend oppositely to form a pair of rectangular receiving grooves 114 extending longitudinally and having a front opened freely. Each of the receiving grooves 114 extends downward and then extends rearward to form an inserting groove 115. A front end of the inserting groove 115 extends downward to penetrate through the insulating housing 1 to form a fixing groove 116.

The top of the insulating housing 1 further defines a rectangular second mouth 12 penetrating through a rear thereof. A bottom middle of the second space 102 extends downward and then extends rearward to form a rectangular receiving recess 103 higher than the first mouth 11 and having a front communicating with the first space 101. A top and a bottom of the receiving recess 103 respectively define a plurality of second passageways 121 arranged at regular intervals along a transverse direction thereof and each extending longitudinally to penetrate through a front of the second mouth 12 and communicate with the second mouth 12. The front of the second mouth 12 further defines a plurality of second receiving cavities 122 each extending vertically to connect rear ends of the corresponding two second passageways 121. A bottom of the second mouth 12 defines a plurality of third passageways 123 extending rearward from a bottom of the corresponding second receiving cavities 122. A rear end of each third passageway 123 extends downward to penetrate through the insulating housing 1 to form a second fixing cavity 124. Two opposite sides of the second mouth 12 extend oppositely to form a pair of second pivoting grooves 125 in a substantial middle and a pair of second locking grooves 126 opened freely at a rear thereof. Accordingly, a preventing wall 127 is formed between the second pivoting groove 125 and the corresponding second locking groove 126.

Referring to FIG. 2 again, each of the support members 13 has a support bar 131 extending longitudinally. The support bar 131 protrudes upward to form a rectangular preventing block 132 on a substantial middle thereof and a fixing barb 134 at a rear thereof. The support bar 131 protrudes downward to form a soldering block 133 at a front thereof.

Each of the first terminals 2 has a rectangular base board 21 disposed vertically. A front edge of the base board 21 extends forward to form a first bearing arm 22 at top and a first connecting arm 23 longer than the first bearing arm 22 at bottom. A free end of the first bearing arm 22 protrudes downward to form a first interference portion 24. The first connecting arm 23 protrudes upward to form a first contact portion 25 at a substantial middle thereof and extends downward to form a soldering portion 26 at a free end thereof.

Each of the second terminals 3 has a base portion 31 extending vertically. A front edge of the base portion 31 extends forward to form a second connecting arm 32 at top and a third connecting arm 33 shorter than the second connecting arm 32 at bottom. A rear edge of the base portion 31 extends rearward to form a second bearing arm 34 at top and a fourth connecting arm 35 longer than the second bearing arm 34 at bottom. A free end of the second connecting arm 32 protrudes downward to form a second contact portion 321 and a free end of the third connecting arm 33 protrudes upward to form a third contact portion 331. A free end of the second bearing arm 34 protrudes downward to form a second interference portion 341. A free end of the fourth connecting arm 35 extends downward to form a rectangular soldering board 351.

Figure 7:
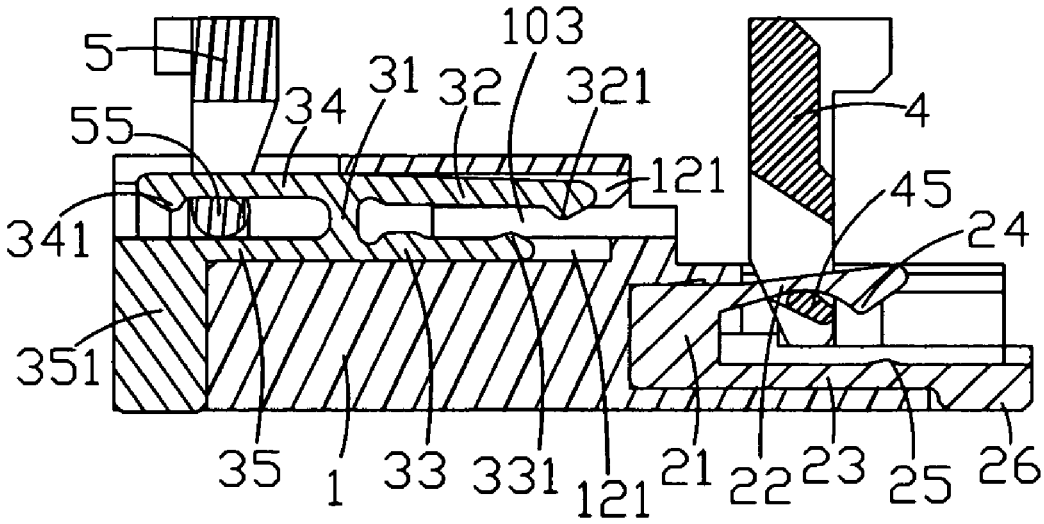
FIG. 7 is a cross-sectional view of the FPC connector along line VII-VII of FIG. 1.

Referring to FIG. 2 and FIG. 7, the first actuator 4 has a substantially rectangular first base body 41 disposed vertically. A bottom of the first base body 41 defines a plurality of first locating slots 43 penetrating from front to rear and arranged at regular intervals along a longwise direction thereof. Accordingly, a plurality of first prop beams 45 are formed under the respective first locating slots 43. Two opposite sides of the first base body 41 protrude outward to form a pair of columned first piloting portions 42 at bottom and a pair of rectangular first locking blocks 44 at top. The second actuator 5 is substantially similar to the first actuator 4 and has a second base body 51, a plurality of second locating slots 53, a pair of columned second pivoting portions 52 and a pair of substantially rectangular second locking blocks 54. A plurality of second prop beams 55 are formed under the respective second locating slots 53 and each have a substantially oval radial-section of which the major axis extends longitudinally to be perpendicular to the second base body 51 and the minor axis extends vertically.

Referring to FIG. 1 and FIGS. 4-7, in assembly, the support bar 131 of the support member 13 is inserted in the corresponding inserting groove 115 of the insulating housing 1 and the fixing barb 134 abuts against an inside of the inserting groove 115. The soldering block 133 is received in the fixing groove 116 for being soldered to a printed circuit board (not shown). The preventing block 132 is positioned in the corresponding receiving groove 114 to divide the receiving groove 114 into a first locking groove 1141 at a front thereof and a first pivoting groove 1142 at a rear thereof. The base board 21 of each first terminal 2 is fastened in the corresponding first receiving cavity 112 and the first bearing arm 22 stretches into the first mouth 11. The first connecting arm 23 is received in the respective first passageway 111 and the first contact portion 25 stretches into the first mouth 11. The soldering portion 26 is inserted in the corresponding first fixing cavity 113 for being soldered to the printed circuit board. The first actuator 4 is rotatably mounted to the first mouth 11 of the insulating housing 1 so as to be opened or closed freely. The first piloting portions 42 are pivoted in the corresponding first pivoting grooves 1142. The free end of the first bearing arm 22 is received in the corresponding first locating slot 43 and the first prop beam 45 is located under the respective first bearing arm 22 behind the corresponding first interference portion 24, so the first actuator 4 can be prevented from falling off the insulating housing 1 while being opened or closed.

The base portion 31 of each of the second terminals 3 is fastened in the corresponding second receiving cavity 122 of the insulating housing 1 and the second bearing arm 34 stretches into the second mouth 12. The second connecting arm 32 and the third connecting arm 33 are respectively received in the corresponding second passageways 121, and the second contact portion 321 and the third contact portion 331 stretch into the receiving recess 103. The fourth connecting arm 35 is received in the respective third passageway 123 and the soldering board 351 is inserted in the corresponding second fixing cavity 124 for being soldered to the printed circuit board. The second actuator 5 is rotatably mounted to the second mouth 12 of the insulating housing 1 so as to be opened or closed freely. The second piloting portions 52 are pivoted in the respective second pivoting grooves 125. The free end of the second bearing arm 34 is received in the corresponding second locating slot 53 and the second prop beam 55 is located under the second bearing arm 34 in front of the corresponding second interference portion 321, so the second actuator 5 can be prevented from falling off the insulating housing 1 while being opened or closed.

When the FPC connector 100 is used, on one hand, the first actuator 4 is opened rearward to make the first FPC board 200 inserted rearward into the first mouth 11 and located between the first bearing arms 22 and the first connecting arms 23 of the first terminals 2 to electrically contact the first contact portions 25. Then the first actuator 4 is closed forward in the first mouth 11 to make the first base body 41 abut against the first FPC board 200 so as to ensure a steadily electrical connection between the first terminals 2 and the first FPC board 200. Moreover, the first locking blocks 44 are buckled into the respective first locking grooves 1141 to make the first actuator 4 closed firmly and further ensure the first terminals 2 electrically contact the first FPC board 200 steadily.

On the other hand, the second actuator 5 is opened forward to make the second FPC board 300 inserted rearward into the receiving recess 103 and located between the second connecting arms 32 and the third connecting arms 33 of the second terminals 3 to electrically contact the second contact portions 321 and the third contact portions 331. Then the second actuator 5 is closed rearward to make the second prop beams 55 push the corresponding second bearing arms 34 upward that drives the corresponding second connecting arms 32 to incline downward and further drives the second contact portions 321 to move downward due to a fulcrum function of the corresponding base portions 31, so the second FPC board 300 can be tightly clipped between the second contact portions 321 and the third contact portions 331 so as to ensure a steadily electrical connection between the second terminals 3 and the second FPC board 300. When the second actuator 5 is fully closed in the second mouth 12, the second locking blocks 54 are buckled into the corresponding second locking grooves 126 to make the second actuator 5 closed firmly and further ensure the second terminals 3 electrically contact the second FPC board 300 steadily.

When the first FPC board 200 and the second FPC board 300 are to be withdrawn from the FPC connector 100, firstly, the second actuator 5 is opened forward to drive the second prop beams 55 rotate to make the second bearing arms 34 move downward due to self-elasticity that further drives the second connecting arms 32 and the second contact portions 321 to move upward due to the fulcrum function of the corresponding base portions 31. So when the second actuator 5 is fully opened, the second FPC board 300 can be easily withdrawn from the receiving recess 103. Then, the first actuator 4 is opened rearward to make the first FPC board 200 withdrawn from the first mouth 11.

As described above, the FPC connector 100 of the present invention can simultaneously receive the first FPC board 200 and the second FPC board 300 therein from the same direction such that can suffice a microminiaturization requirement with the development of electrical field.

What is claimed is:

1. A connector adapted for receiving at least two flexible printed circuit boards therein, comprising:

an insulating housing defining a first mouth at a front thereof and a receiving recess behind the first mouth, the first mouth having a top and a front opened freely, the receiving recess being higher than the first mouth and having a front opened freely;

a plurality of first terminals disposed in a front of the insulating housing and stretching into the first mouth;

a first actuator rotatably mounted to the first mouth of the insulating housing; and a plurality of second terminals disposed in a rear of the insulating housing and each having a second connecting arm at an upper portion thereof and a third connecting arm at a lower portion thereof, a free end of the second connecting arm protruding downward to form a second contact portion and a free end of the third connecting arm protruding upward to form a third contact portion, the second and third contact portions stretching into the receiving recess;

wherein one of the flexible printed circuit boards can be inserted into the first mouth and pressed downward by the first actuator to electrically contact the first terminals, and the other flexible printed circuit board can be inserted into the receiving recess and clipped between the second and third connecting arms to electrically contact the second and third contact portions of the second terminals.

2. The connector as claimed in claim 1, wherein the insulating housing further defines a second mouth at a rear thereof, the second mouth has a top and a rear opened freely and communicates with a rear of the receiving recess, the second terminals further stretch into the second mouth, the connector further includes a second actuator rotatably mounted to the second mouth, the second actuator can act on the second terminals to make the second connecting arms inclined toward the corresponding first connecting arms for further clipping the corresponding flexible printed circuit board therebetween when the second actuator is closed.

3. The connector as claimed in claim 2, wherein each of the second terminals has a base portion extending vertically, the second connecting arm is formed by extending forward from a top of a front edge of the base portion and the third connecting arm is formed by extending forward from a bottom of the front edge of the base portion, a top of a rear edge of the base portion extends rearward to form a second bearing arm stretching into the second mouth to cooperate with the second actuator.

4. The connector as claimed in claim 3, wherein the second connecting arm is longer than the third connecting arm.

5. The connector as claimed in claim 3, wherein a top and a bottom of the receiving recess respectively define a plurality of second passageways for receiving the respective second and third connecting arms therein, a front of the second mouth defines a plurality of second receiving cavities connecting rear ends of the corresponding two second passageways for fastening the respective base portions therein.

6. The connector as claimed in claim 3, wherein each of the second terminals further has a fourth connecting arm extended rearward from a bottom of the rear edge of the base portion, a bottom of the second mouth defines a plurality of third passageways for receiving the respective fourth connecting arms therein.

7. The connector as claimed in claim 3, wherein the second actuator has a second base body defining a plurality of second locating slots, a plurality of second prop beams are accordingly formed at one end of the respective second locating slots, a free end of each of the second bearing arms protrudes downward to form a second interference portion, the second bearing arms pass through the corresponding second locating slots and the second interference portions can be received in the respective second locating slots when the second actuator is closed.

8. The connector as claimed in claim 7, wherein each of the second prop beams has a substantially oval radial-section, of which the major axis is perpendicular to the second base body and the minor axis substantially lies in the same plane with the second base body.

9. The connector as claimed in claim 7, wherein two opposite sides of the second mouth extend oppositely to form two facing second pivoting grooves and two facing second locking grooves at a rear thereof, two opposite sides of the second base body protrude outward to form two second piloting portions pivoted in the respective second pivoting grooves, the two opposite sides of the second base body further protrude outward to form two second locking blocks capable of being buckled into the corresponding second locking grooves when the second actuator is closed.

10. The connector as claimed in claim 1, wherein two opposite sides of the first mouth extend oppositely to form two receiving grooves, each of the receiving grooves extends downward and further rearward to form an inserting groove, the connector further includes two support members each having a support bar extending longitudinally and inserted in the corresponding inserting groove, the support bar protrudes upward to form a preventing block positioned in the receiving groove to divide the receiving groove into a first locking groove at a front thereof and a first pivoting groove at a rear thereof, the first actuator has a first base body, two opposite sides of the first base body protrude outward to form two first piloting portions pivoted in the corresponding first pivoting grooves, the two opposite sides of the first base body further protrude outward to form two first locking blocks capable of being buckled into the corresponding first locking grooves when the first actuator is closed.

* * * * *